United States Patent [19]

Price et al.

[11] Patent Number: 4,807,836

[45] Date of Patent: Feb. 28, 1989

[54] VERTICAL AND PIVOTAL ADJUSTING APPARATUS FOR DRAFTING TABLES

[75] Inventors: Macy J. Price, Golden, Colo.; Mario B. Accumanno, Cedar Grove, N.J.; Daniel C. Starkey, Englewood, Colo.

[73] Assignee: Engineered Data Products, Inc., Broomfield, Colo.

[21] Appl. No.: 168,487

[22] Filed: Mar. 15, 1988

[51] Int. Cl.[4] ..... F16L 3/00

[52] U.S. Cl. ..... 248/123.1; 108/147; 248/125; 248/162.1

[58] Field of Search ..... 248/123.1, 125, 161, 248/162.1, 157, 297.1; 108/147, 146, 6

[56] References Cited

U.S. PATENT DOCUMENTS

| | | | |
|---|---|---|---|
| 3,908,944 | 9/1975 | Bjork | 248/162.1 |
| 3,920,209 | 11/1975 | Komura | 248/162.1 |
| 3,989,211 | 11/1976 | Gundlach | 248/162.1 |
| 4,094,484 | 6/1978 | Galione | 248/162.1 |
| 4,111,389 | 9/1978 | Gundlach et al. | 248/162.1 |
| 4,156,391 | 5/1979 | Ubezio . | |
| 4,183,689 | 1/1980 | Wirges et al. | 248/161 X |
| 4,188,007 | 2/1980 | Ubezio . | |
| 4,605,189 | 8/1986 | Bruneau | 248/162.1 |

OTHER PUBLICATIONS

R. S. Knapp Co. Inc./ NapcoCopy Graphics Center (2 pages from a catalogue published by Alvin & Co., Inc., Denver, Colo.).

Constant-Force Springs (2 pages from a publication by Associates Spring of the Barnes Group Inc.).

*Primary Examiner*—Ramon O. Ramirez

*Attorney, Agent, or Firm*—Klaas & Law

[57] ABSTRACT

Apparatus for supporting a drafting table, such as a digitizer, for vertical and pivotal movement thereof wherein a fixed hollow column is supported on a base member and a movable hollow column is mounted inside of the fixed hollow column for vertical up or down movement thereof and wherein the weight of the drafting table is counter-balanced by a constant spring mounted on the upper portion of the fixed hollow column and on the lower portion of the movable hollow column so that a portion of the constant spring is between the fixed and movable hollow columns and an elongated support member mounted on the upper portion of the movable hollow column and extending generally in a horizontal direction for supporting the drafting table and pivot means for pivotally connecting the drafting table to the elongated support member.

20 Claims, 3 Drawing Sheets

FIG. 3
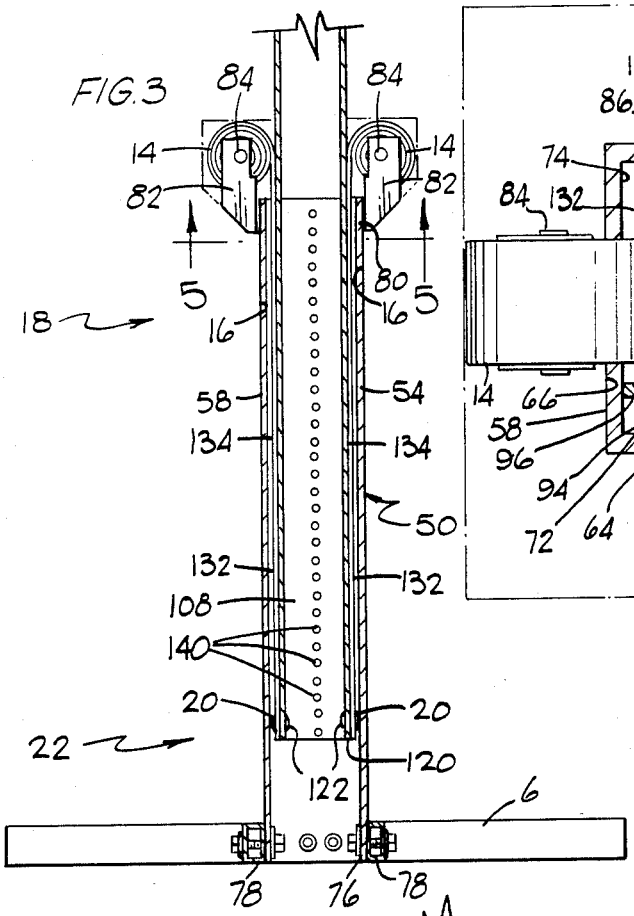
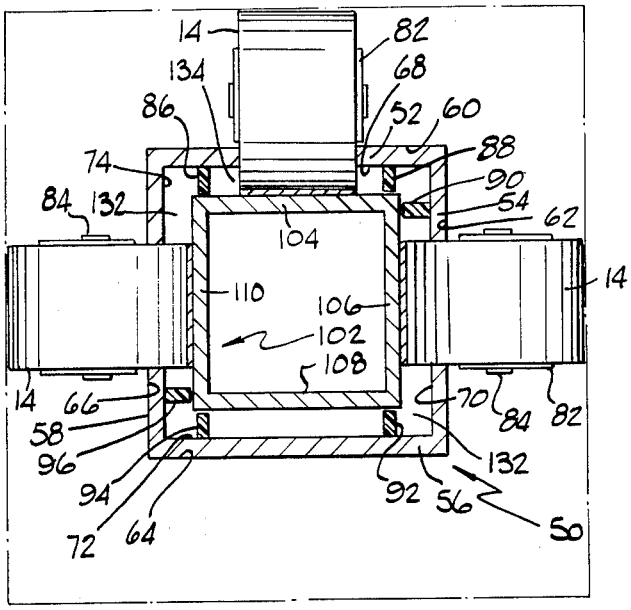
FIG 5
FIG. 4
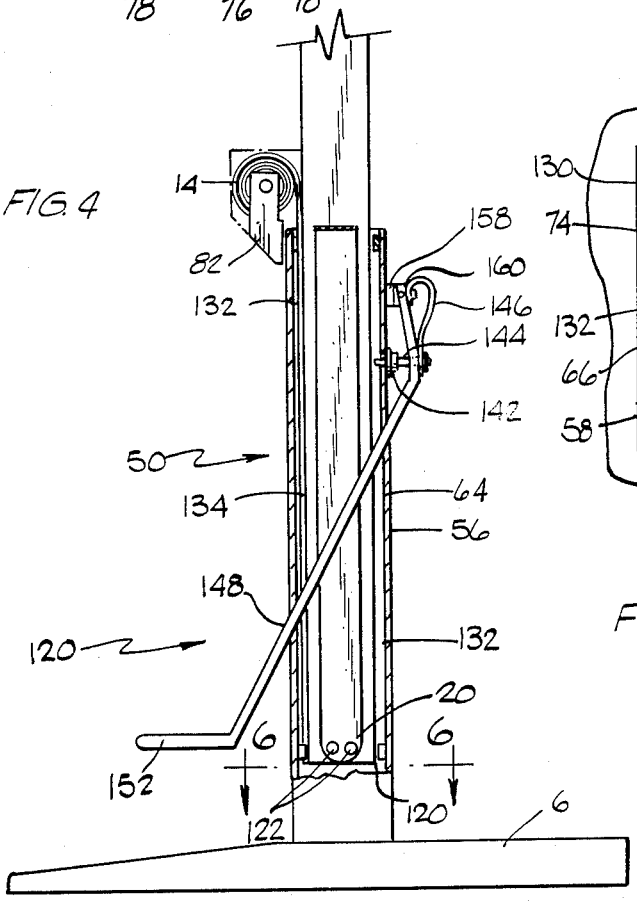
FIG. 6
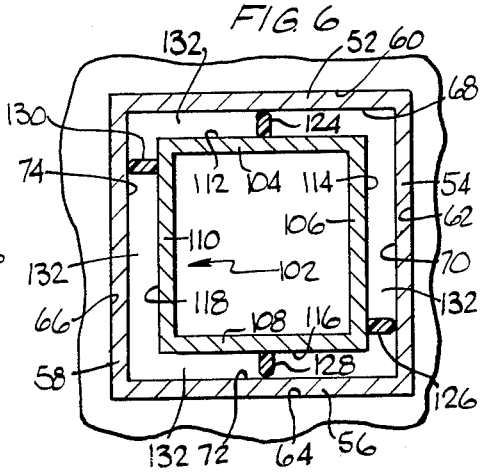
FIG. 7
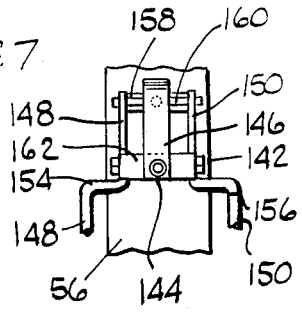

FIG. 8
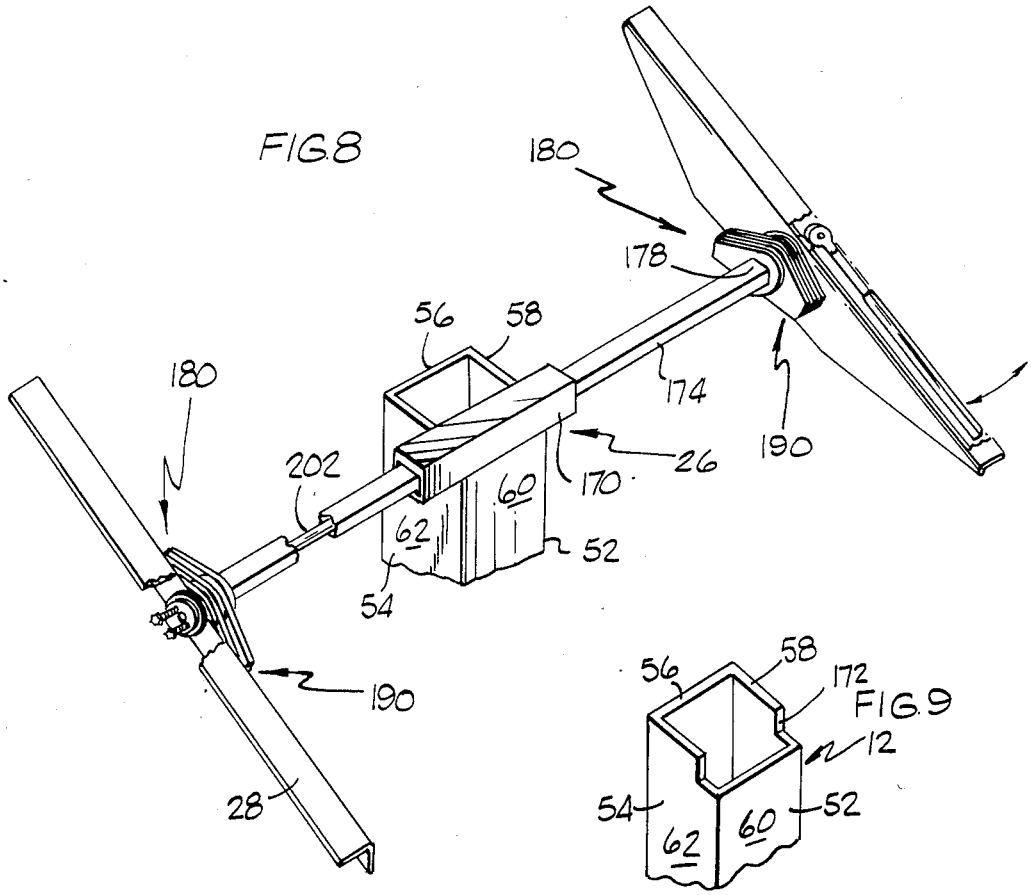
FIG. 9
FIG. 10
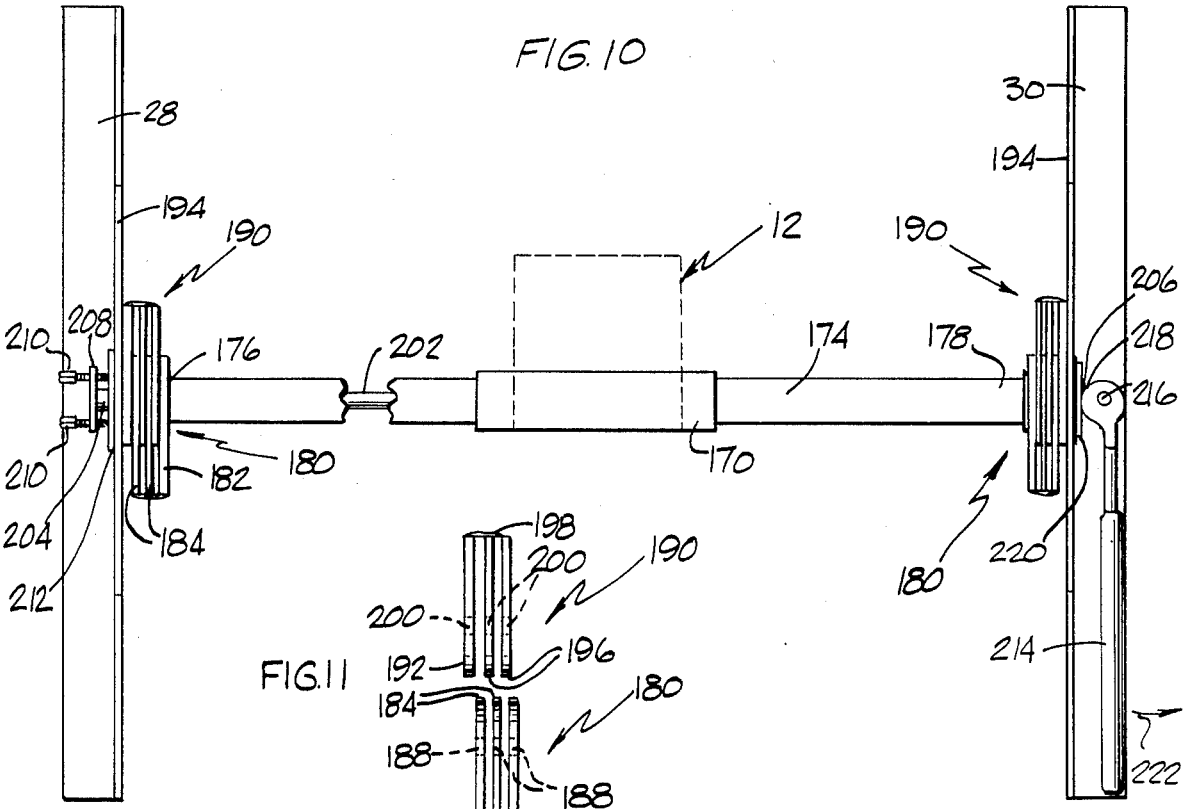
FIG. 11
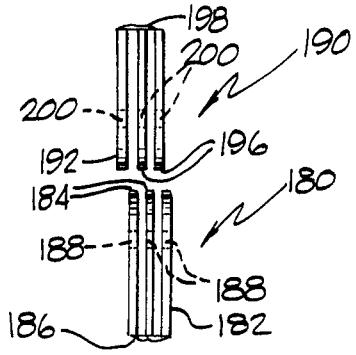

VERTICAL AND PIVOTAL ADJUSTING APPARATUS FOR DRAFTING TABLES

FIELD OF THE INVENTION

This invention relates generally to the field of drafting tables for making drawings and is particularly directed to drafting tables for making drawings which drafting tables are provided with apparatus so that the height and angular relationship of the drafting table may be adjusted.

BACKGROUND OF THE INVENTION

There have been many types of apparatus developed for use in providing height and pivotal adjustment for drafting tables. In Ubezio, U.S. Pat. No. 4,156,391, there is disclosed apparatus for providing height and pivotal adjustment for a drafting table wherein the height adjustment is accomplished using one or more leaf springs. In Ubezio, U.S. Pat. No. 4,188,007, there is disclosed apparatus for providing height and pivotal adjustment for a drafting table wherein the height adjustment is accomplished using a gas spring and the pivotal adjustment comprises conical ends in conical bushings and force applying means using an eccentric member. Other apparatus for providing height and pivotal adjustments for drafting tables employ hydraulic and electrical systems. While these systems provide for the height and pivotal adjustments of drafting tables, there is always a need for improved apparatus for such purposes.

BRIEF DESCRIPTION OF THE INVENTION

This invention is directed to apparatus for providing height and pivotal adjustment of a drafting table using at least one constant force spring means for the height adjustment and friction applying means for controlling the pivotal adjustment.

In the preferred embodiment of the invention, the apparatus for supporting a drafting table, preferably a digitizer, comprises base means adapted to be supported on a fixed surface. Fixed hollow column means are mounted on the base means and movable hollow column means are mounted within the fixed hollow column means so that the movable hollow column means can move in vertical directions. The movable hollow column means has a cross-sectional configuration which is smaller than the cross-sectional configuration of the fixed hollow column means and which cross-sectional configurations are preferably rectangular having four sides. Guide means are provided on the inner surface of the fixed hollow column means and on the outer surfaces of the movable hollow column means for guiding the movement of the movable hollow column means and for providing a space between the fixed hollow column means and the movable hollow column means. At least one constant force spring means is mounted on an outer surface of the fixed hollow column means adjacent to an upper portion thereof and has an end portion thereof secured to the movable hollow column means adjacent to a lower portion thereof so that at least a portion of the at least one constant force spring means is located in the space between the fixed hollow column means and the movable hollow column means. The at least one constant force spring means counterbalances the weight of the drafting table member so that said movable hollow column means may be readily movable up or down in vertical directions. Support means are secured to the movable hollow column means adjacent to an upper portion thereof for supporting a drafting table member. Locking means are provided for holding the movable hollow column means at a desired position. Pivot means are provided for pivotally mounting the drafting table to the support means and comprises first pivot bracket means secured to the ends of a hollow elongated support means and second pivot bracket means secured to spaced apart support bracket means on the drafting table member with the first and second pivot bracket means each having a plurality of resilient spaced apart sheet-like members which are arranged in an interleaved relationship. Force applying means are provided to urge the sheet-like members into contacting relationship to provide frictional forces to prevent rotation of the drafting table member which can be rotated when the force applying means are released.

BRIEF DESCRIPTION OF THE DRAWINGS

An illustrative and presently preferred embodiment of the invention is shown in the accompanying drawings in which:

FIG. 3 is a cross-sectional view of a portion of FIG. 2 looking from the rear;

FIG. 4 is a cross-sectional view of a portion of FIG. 2 looking from the side;

FIG. 5 is a cross-sectional view taken on the line 5—5 of FIG. 3;

FIG. 6 is a cross-sectional view taken on the line 6—6 of FIG. 4;

FIG. 7 is an elevational view of a portion of FIG. 6;

FIG. 8 is a perspective view showing the pivotal adjustment means;

FIG. 9 is a perspective view of a portion of FIG. 8;

FIG. 10 is a bottom plan view of FIG. 8; and

FIG. 11 is an exploded bottom plan view of the first and second pivot bracket means of FIG. 10.

DETAILED DESCRIPTION OF THE INVENTION

Figure 1:
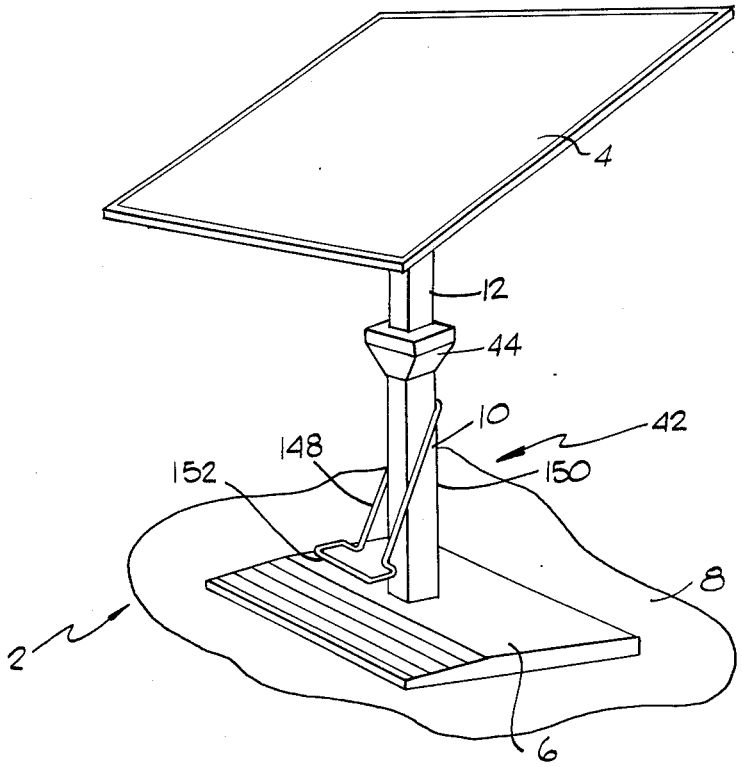
FIG. 1 is a perspective view of the drafting table of this invention.
Figure 2:
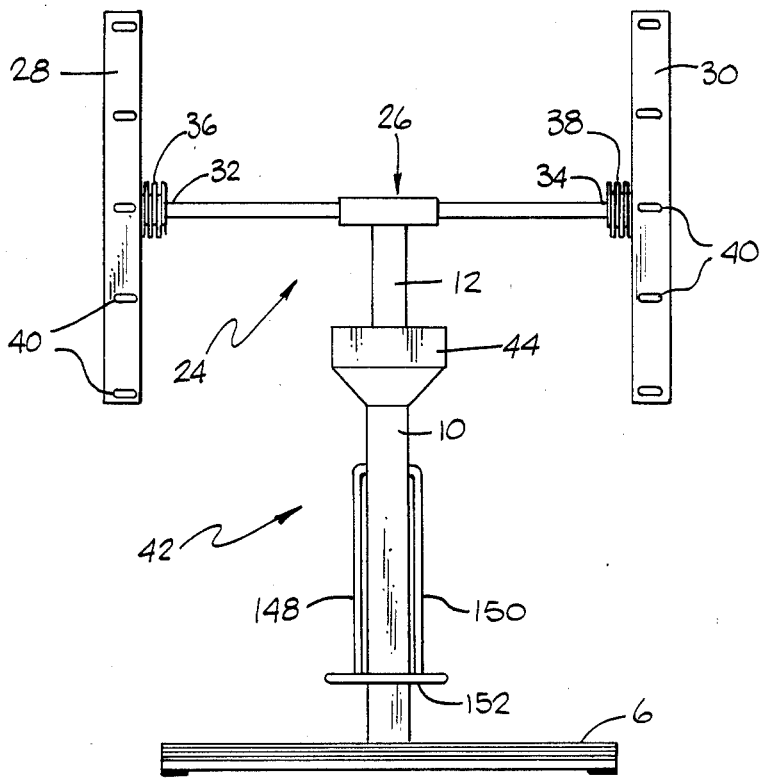
FIG. 2 is a front plan view of FIG. 1.

The preferred embodiment of the invention is illustrated in the drawing, FIGS. 1 and 2, and comprises apparatus 2 for supporting a drafting table member 4, such as a digitizer, for providing height and pivotal adjustment movements therefor. The apparatus 2 comprises a base means 6 which is adapted to be supported on a fixed surface 8, such as a floor, a fixed hollow column means 10 mounted on the base means 6 and a movable hollow column means 12 mounted for vertical movement in the fixed hollow column means 10. To provide for such vertical movement, the cross-sectional configuration of the movable hollow column means 12 is smaller than the cross-sectional configuration of the fixed hollow column means 10. Guide means (described below) are provided on inner surfaces of the fixed hollow column means 10 and on outer surfaces of the movable hollow column means for guiding the vertical movements of the movable hollow column means 12 and for providing a space between the fixed hollow column means 10 and the movable hollow column means 12, for purposes described below. A plurality of constant force spring means 14, FIG. 3, are mounted on outer surfaces 16 of the fixed hollow column means 10 adjacent to an upper portion 18 thereof and each of the constant force spring means 14 has an end portion 20 secured to the movable hollow column means 12 adjacent to a lower portion 22 thereof. The constant force spring means 14 function to counterbalance the weight of the drafting table member 4 and other portions of the apparatus supported thereon so that the drafting table member 4 can be readily moved in vertical directions. The number of constant force spring means 14 used in the apparatus 2 of this invention depends on the weight of the drafting table member 4 and the other associated apparatus. Three constant force spring means 14 are disclosed in this application but the structure disclosed herein can be utilized with between one and four constant spring means 14. Support means 24, FIG. 2, are used to secure the drafting table member 4 to the movable hollow column means 12 and comprise a hollow elongated support means 26 securely mounted on the movable hollow column means 12. A pair of spaced apart support bracket means 28 and 30 are connected to the ends 32 and 34 of the hollow elongated support means 26 by pivot means 36 and 38. Each of the spaced apart support bracket means 28 and 30 is provided with a plurality of spaced apart openings 40 so that fastening devices (not shown) may pass therethrough to secure the drafting table member 4 to the spaced apart support bracket means 28 and 30 for movement therewith. Locking means 42 described more fully below, are provided for holding the movable hollow column means 12 at a desired position. Protective cover means 44 are secured to the fixed hollow column means 10 to cover and provide protection for the constant force spring means 14.

The fixed hollow column means 10 and the movable hollow column means 12 are illustrated more fully in FIGS. 3–6. The fixed hollow column means 10 comprises an elongated tube 50 having a rectangular cross-sectional configuration having four sides 52, 54, 56 and 58 having outer surfaces 60, 62, 64 and 66 and inner surfaces 68, 70, 72 and 74. This elongated tube 50 is secured at one end 76 thereof to the base means 6 by nuts and bolts 78. Adjacent to the other end 80, there is mounted on outer surfaces 60, 62 and 66 a support bracket 82 in which is mounted a shaft 84 on which a constant force spring means 14 is rotatably mounted. As illustrated in FIGS. 3 and 4, the constant spring means 14 are mounted on the upper portion of the outer surface of the fixed hollow column means 10 so that the end portion 20 thereof passes directly into the space between the fixed hollow column means 10 and the movable hollow column means 12. Since the end portion 20 of the constant force spring means 14 is secured to the lower portion 22 of the movable hollow column means 12, as the movable hollow column means 12 is moved vertically, substantially all of any exposed portion of the constant spring means 14 is located in the space between the fixed and movable column means and protected thereby. Spaced apart guide means 86 and 88 are secured to the inner surface 68, guide means 90 is secured to the inner surface 70, spaced apart guide means 92 and 94 are secured to the inner surface 72 and guide means 96 is secured to the inner surface 74.

The movable hollow column means 12 comprises an elongated tube 102 having a rectangular cross-sectional configuration having four sides 104, 106, 108 and 110 having outer surfaces 112, 114, 116 and 118. The end portion 20 of each constant spring means 14 is secured to the sides 106, 108 and 110 adjacent to one end 120 of the elongated tube 102 by suitable means, such as rivets 122. Guide means 124, 126, 128 and 130 are secured respectively to the outer surfaces 112, 114, 116 and 118. The guide means 86, 88, 90, 92, 94 and 96 cooperate with the guide means 124, 126, 128 and 130 to guide the vertical movements of the movable hollow column means 12 and also, to provide a space 132 between the fixed hollow column means 10 and the movable hollow column means 12 for a portion 134 of each constant force spring means 14. The guide means 86–96 and 124–130 are formed from a material having a low coefficient of friction such as nylon or other materials having similar characteristics.

Locking means 120 are illustrated in FIGS. 3 and 4 and comprise a plurality of spaced apart openings 140 extending in a vertical direction in the side 108 of the movable hollow column means 12. A bracket 142 is mounted on the outer surface 64 of the side 56 and slidably supports a pin 144 which is urged by spring means 146 toward the movable hollow column means 12 so as to enter into one of the openings 140. The locking means 120 has a pair of spaced apart lever arms 148 and 150, FIGS. 1 and 2, having one end thereof connected by a cross bar 152 adapted to be contacted by a foot of the operator. The lever arms 148 and 150 have portions 154 and 156, FIG. 7, which move the lever arms 148 and 150 closer together. A pivot support bracket 158 is securely mounted on the outer surface 64 and has a pivot pin 160 on which the lever arms 148 and 150 are rotatably mounted. A bearing plate 162 is secured to the lever arms 148 and 150 and to the slidable pin 144 so that when a downwardly directed force is applied to the cross-bar 152, the lever arms 148 and 150 will be rotated around the pivot pin 160 and pull the slidable pin 144 out of the one opening 140 to allow the movable hollow column means 12 to be moved up or down in vertical directions.

The pivotal mounting of the drafting table member 4 is illustrated in FIGS. 8–11 wherein the hollow elongated support means 26 has a central portion 170 which is securely mounted in a recess 172 in the movable hollow column means 12 by suitable means, such as by welding. An elongated hollow tube 174 passes through and is secured to the central portion 170 and has two opposite end portions 174 and 176. First pivot bracket means 180 are secured to the elongated hollow tube 174 adjacent each of the end portions 176 and 178 and comprise a first base member means 182 secured to the elongated hollow tube 174 by suitable means, such as by welding, and a plurality of resilient spaced apart sheet-like members 184 which are held in spaced apart relationship by suitable means, such as by welds 186. Aligned openings 188 extend through the base member means 182 and the resilient sheet-like members 184. Second pivot bracket means 190 are secured to each of the spaced apart bracket means 28 and 30 and comprise a second base member means 192 secured to a flange 194 of the bracket means 28 by suitable means such as by welding and a plurality of resilient spaced apart sheetlike members 196 which are held in the spaced apart relationship by suitable means such as welds 198. Aligned openings 200 extend through the base member means 182 and the resilient sheet-like members 196.

A pivot rod means 202 extends through the flanges 194, the first and second pivot bracket means 180 and 190 and the elongated hollow tube 174 and has one end 204 extending outwardly from the flange 194 of the bracket means 28 and another end 206 extending outwardly from the flange 194 of the bracket means 30. As illustrated in FIG. 10, when the first and second pivot bracket means 180 and 190 are in assembled relationship, the base member means 182 and 192 and the resilient sheet-like members are in an interleaved relationship with portions thereof adapted to be moved into a contacting relationship. Plate member means 208 are secured to the one end 204 and have a cross-sectional configuration greater than the cross-sectional configuration of the opening in the flange 194 to prevent movement of the plate member means 208 through the opening. At least two adjusting screw means 210 are threadedly mounted in the plate member means 208 and bear against a bearing plate 212 secured to the flange 194 for purposes described below. Handle means 214 are pivotally mounted on the another end 206 by a pivot means 216. The handle means 216 have an eccentric cam surface 218 which bears against a bearing plate 220 secured to the flange 194 of the bracket means 30. In FIG. 10, the handle means 214 are located so as to prevent pivotal movement of the spaced apart bracket means 28 and 30 and therefore the drafting table member 4. Rotation of the handle means 214 in the direction indicated by the arrow 222 to a release position will move the eccentric cam surface 218 and allow pivotal movement of the spaced apart bracket means 28 and 30 as described below.

In operation with the handle means 214 in the release position, the adjusting screw means 210 are rotated so as to apply a force tending to pull the one end 204 of the pivot rod means 202 away from the flange 194 of the bracket means 28. This causes the bearing plate 212 to put an inwardly directed force on the flange 194 of the bracket means 28 and an inwardly directed force on the flange 194 of the bracket means 30 so as to move the interleaved portions of the base member means 182 and 192 and the sheet-like members 184 and 186 into contacting relationship so as to provide a slight frictional force resisting pivotal movement of the spaced apart bracket means 28 and 30 to provide controlled pivotal movement of the drafting table member 4. After the drafting table member 4 has been pivoted to a desired position, the handle means 214 are rotated to a lock position wherein the force applying portion of the eccentric cam surface 218 is against the bearing plate 220. When moved to the lock position, the eccentric cam surface 218 exerts a force on the pivot rod means 202 which results in an inwardly directed force on the flange 194 of the bracket means 30 and an inwardly directed force on the flange 194 of the bracket means 28 so as to move the interleaved portions of the base member means 182 and 192 and the sheet-like members 184 and 196 into hard contacting relationship so as to provide sufficient frictional forces therebetween so as to prevent pivotal movement of the spaced apart bracket means 28 and 30 and therefore also of the drafting table member 4.

When it is desired to make a vertical adjustment of the drafting table member 4, the cross bar 152 is depressed to move the slidable pin 144 out of an opening 140 to permit movement of the movable hollow column mean 12. The constant force spring means 14 provide a counterbalancing force for the weight of the drafting table member 4 and the apparatus connected thereto so that only a slight force is required to be placed upon the drafting table member 4 so as to move it upwardly or downwardly in vertical directions. After the drafting table member 4 has been moved to a desired position, the force on the cross bar 152 is removed and the spring means 146 urges the slidable pin 144 into an opening 140 to lock the movable hollow column means 4 in position.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. Apparatus for supporting a drafting table member comprising:

a base means adapted to be supported on a fixed surface;

a fixed hollow column means mounted on said base means and extending upwardly therefrom and terminating at an upper end portion;

a movable hollow column means having at least a portion thereof mounted in said fixed hollow column means so that said movable hollow column means can move in vertical directions;

said movable hollow column means having a cross-sectional configuration which is smaller than the cross-sectional configuration of said fixed hollow column means;

guide means between said fixed hollow column means and said movable hollow column means for guiding the movement of said movable hollow column means and for providing a space between opposite portions of said fixed hollow column means and said movable hollow column means;

at least one constant force spring means for providing a counterbalancing force mounted on an outer surface of said fixed hollow column means adjacent to said upper end portion thereof;

said at least one constant force spring means having an end portion thereof secured to said movable hollow column means adjacent to the lowermost portion thereof so that substantially all of any exposed portion of said at least one constant force spring means is located in said space between said fixed hollow column means and said movable hollow column means;

a drafting table member;

support means secured to said movable hollow column means adjacent to an upper portion thereof for supporting said drafting table member;

said at least one constant force spring means counterbalancing the weight of said drafting table member so that said movable hollow column means is readily movable up or down in vertical directions; and locking means for holding said movable hollow column means at a desired position.

2. Apparatus as in claim 1 wherein:

said cross-sectional configuration of said fixed hollow column means and of said movable hollow column means is rectangular having four sides.

3. Apparatus as in claim 2 wherein said locking means comprises:

a plurality of spaced apart openings extending in a vertical direction in one of said sides of said movable hollow column means;

a slidable pin mounted at a fixed location on an outer surface of one of said sides of said fixed hollow column means which side is opposite to and facing said one of said sides of said movable hollow column means having said spaced apart openings therein;

said slidable pin having a sufficient length to enter one of said spaced apart openings to prevent movement of said movable hollow column means;

resilient means for urging said slidable pin into one of said spaced apart openings; and pedal means for applying a force to overcome said resilient means and move said slidable pin out of said one of said openings so that said movable hollow column means can be moved in vertical direction.

4. Apparatus as in claim 1 wherein said at least one constant force spring means comprises:

a plurality of constant force spring means mounted on a plurality of said sides of said fixed hollow column means.

5. Apparatus as in claim 1 and further comprising:

protective cover means secured to said fixed hollow column means; and said at least one constant spring means being located within said protective cover means.

6. Apparatus as in claim 1 wherein said guide means comprises:

a plurality of guide bushings comprising a material having a low coefficient of friction and secured at spaced apart intervals to the inner surfaces of said sides of said fixed hollow column means at a location adjacent to said upper portion thereof; and a plurality of guide bushings comprising a material having a low coefficient of friction and secured to the outer surfaces of said sides of said movable hollow column means at a location adjacent to said lower portion thereof.

7. Apparatus as in claim 1 and further comprising:

pivot means for pivotally mounting said drafting table member to said support means.

8. Apparatus as in claim 7 wherein:

said cross-sectional configuration of said fixed hollow column means and of said movable hollow column means is rectangular having four sides.

9. Apparatus as in claim 8 wherein said at least one constant force spring means comprises:

a plurality of constant force spring means mounted on a plurality of said sides of said fixed hollow column means.

10. Apparatus as in claim 8 and further comprising:

protective cover means secured to said fixed hollow column means; and said at least one constant spring means being located within said protective cover means.

11. Apparatus as in claim 8 wherein said guide means comprises:

a plurality of guide bushing comprising a material having a low coefficient of friction and secured at spaced apart intervals to the inner surfaces of said sides of said fixed hollow column means at a location adjacent to said upper portion thereof; and a plurality of guide bushings comprising a material having a low coefficient of friction and secured to the outer surfaces of said sides of said movable hollow column means at a location adjacent to said lower portion thereof.

12. Apparatus as in claim 11 wherein said locking means comprises:

a plurality of spaced apart openings extending in a vertical direction in one of said sides of said movable hollow column means;

a slidable pin mounted at a fixed location on an outer surface of one of said sides of said fixed hollow column means which side is opposite to and facing said one of said sides of said movable hollow column means having said spaced apart openings therein;

said slidable pin having a sufficient length to enter one of said spaced apart openings to prevent movement of said movable hollow column means;

resilient means for urging said slidable pin into one of said spaced apart openings; and pedal means for applying a force to overcome said resilient means and move slidable in out of said openings so that said movable hollow column means can be moved in vertical directions.

13. Apparatus as in claim 7 wherein said pivot means comprises:

an elongated hollow tube secured to said upper portion of said movable hollow column means and extending generally in a horizontal direction;

said elongated hollow tube having two opposite end portions;

first pivot bracket means secured to each of said two opposite end portions and having an opening extending therethrough and into said elongated hollow tube;

a pair of spaced apart support bracket means secured to a bottom surface of said drafting table member;

second pivot bracket means secured to each of said spaced apart support bracket means and having an opening extending therethrough;

an opening in each of said spaced apart support bracket means aligned with said opening in said second pivot bracket means;

pivot rod means extending through said openings in said pair of spaced apart support bracket means, said first and second pivot bracket means and said elongated hollow tube to provide for relative rotational movement between said first and second pivot bracket means;

said pivot rod means having one end extending outwardly from one of said spaced apart support bracket means and another end extending outwardly from another of said spaced apart bracket means;

plate member means secured on said one end of pivot rod means; said plate member means having a cross-sectional configuration greater than the cross-sectional configuration of said opening in said one of said spaced apart support bracket means to prevent movement of said plate member means into said opening in said one of said spaced apart support bracket means;

handle means on said another end of said pivot rod means; and force applying means for applying a force to said first and second pivot bracket means so as to prevent the rotation thereof around said pivot rod means.

14. Apparatus as in claim 13 wherein said first pivot bracket means comprises:

a first base member means secured to each of said two opposite end portions of said hollow elongated support means;

a plurality of resilient spaced apart sheet-like members secured to each of said first base member means;

said opening extending through said first base member means and said plurality of spaced apart sheetlike members; said second pivot bracket means comprises:

a second base member means secured to each of said spaced apart support bracket means;

a plurality of resilient spaced apart sheet-like members secured to each of said second base member means;

said opening extending through said second base member means and said plurality of spaced apart sheet-like members; and said plurality of sheet-like members being interleaved with each other and said first and second base member means.

15. Apparatus as in claim 14 wherein:

said force applying means applying forces on said second base member means to move them toward said first base member means so that said first and second base member means and said plurality of sheet-like members are in contact with each other to provide frictional forces to prevent the rotation of said first and second pivot bracket means around said pivot rod means.

16. Apparatus as in claim 15 wherein said force applying means comprises:

cam means on the end of said handle means and having a cam surface;

pivot means for pivotally mounting said handle means on said another end of said pivot rod means so that said cam surface will contact said another of said spaced apart bracket means so that said cam surface can apply a force on said another of said spaced apart bracket means tending to move said piston rod means outwardly away from said another of said spaced apart bracket means and resulting in inwardly directed forces moving each of said second base member means toward each of said first base member means so as to move the interleaved portions of said base member means and said sheet-like members into hard contacting relationship so as to provide sufficient frictional forces to prevent relative rotation movement between said first and second pivot bracket means.

17. Apparatus as in claim 16 and further comprising:

adjustable means on said plate member means bearing against said one of said spaced apart bracket means so as to move each of said second base member means toward each of said first base member means so as to provide light frictional contact between said first and second base member means and said plurality of sheet-like members to provide for controlled pivotal movement of said drawing table member.

18. Apparatus as in claim 17 wherein:

said cross-sectional configuration of said fixed hollow column means and of said movable hollow column means is rectangular having four sides; and said guide means comprises:

a plurality of guide bushings comprising a material having a low coefficient of friction and secured at spaced apart intervals to the inner surfaces of said sides of said fixed hollow column means at a location adjacent to said upper portion thereof; and a plurality of guide bushings comprising a material having a low coefficient of friction and secured to the outer surfaces of said sides of said movable hollow column means at a location adjacent to said lower portion thereof.

19. Apparatus as in claim 18 and further comprising:

a plurality of constant force spring means mounted on a plurality of said sides of said fixed hollow column means.

20. Apparatus as in claim 19 and further comprising:

protective cover means secured to said fixed hollow column means; and said plurality of constant spring means being located within said protective cover means.

* * * * *

UNITED STATES PATENT AND TRADEMARK OFFICE

CERTIFICATE OF CORRECTION

PATENT NO. : 4,807,836

DATED : February 28, 1989

INVENTOR(S) : Macy J. Price, Mario B. Accumanno, Daniel C. Starkey

It is certified that error appears in the above-identified patent and that said Letters Patent is hereby corrected as shown below:

Claim 12, Column 8, lines 13 and 14, after "move", "slidable in out of said openings" should read -- said slidable pin out of said one of said openings --.

Signed and Sealed this

Fifteenth Day of August, 1989

*Attest:*

DONALD J. QUIGG

*Attesting Officer*

*Commissioner of Patents and Trademarks*